United States Patent [19]

Röck

[11] Patent Number: 4,961,614

[45] Date of Patent: Oct. 9, 1990

[54] DRAWER INCLUDING IMPROVED LATERAL AND VERTICAL ADJUSTMENT ASSEMBLY

[75] Inventor: Erich Röck, Höchst, Austria

[73] Assignee: Julius Blum Gesellschaft m.b.H., Höchst, Austria

[21] Appl. No.: 445,773

[22] Filed: Dec. 4, 1989

[30] Foreign Application Priority Data

Dec. 5, 1988 [AT] Austria ..... 2973/88

[51] Int. Cl.[5] ..... A47B 88/00

[52] U.S. Cl. ..... 312/341.1

[58] Field of Search ..... 312/330.1, 341.1, 336, 312/337

[56] References Cited

U.S. PATENT DOCUMENTS

| | | | |
|---|---|---|---|
| 4,412,703 | 11/1983 | Simonson | 312/341.1 X |
| 4,465,324 | 8/1984 | Röck et al. | 312/341.1 X |
| 4,810,045 | 3/1989 | Lautenschläger | 312/341.1 X |

*Primary Examiner*—Joseph Falk

*Attorney, Agent, or Firm*—Wenderoth, Lind & Ponack

[57] ABSTRACT

A drawer includes a bottom, two side walls, a rear wall and a front plate. On each side of the drawer, there is provided a pull-out rail mounted on the drawer and a supporting rail fastened to a furniture body. Rollers, balls or slides are arranged between the supporting rails and the pull-out rails. The pull-out rails and the supporting rails are guided without clearance. On each side of the drawer, adjusting device are provided adjacent to the front plate for vertical and lateral adjustment of the drawer with respect to the pull-out rails. Each adjusting device has an oblong hole which is aligned parallel to the front plate and through which projects a clamping screw which engages in a female thread in a horizontal flange of the pull-out rail. Each of the adjusting devices is connected to the drawer by a vertically adjustable holding member.

12 Claims, 4 Drawing Sheets

DRAWER INCLUDING IMPROVED LATERAL AND VERTICAL ADJUSTMENT ASSEMBLY

FIELD AND BACKGROUND OF THE INVENTION

The present invention relates to a drawer comprising a bottom, two side walls, a rear wall and a front plate, a pull-out rail on each side of the drawer, a supporting rail fastened to a furniture body on each side of the drawer, and rollers, balls or slides arranged between the supporting rails and the pull-out rails. The pull-out rails and the supporting rails are, in a manner known per se, laterally and vertically non-adjustable with respect to each other, and preferably are guided without clearance. Adjusting means are provided on each side of the drawer adjacent to the front plate for vertically and laterally adjusting the position of the drawer with respect to the pull-out rails.

Modern furniture construction requires laterally stable guiding of the drawer, which means that the drawer does not wobble when being pulled out and pushed in, and that no jerk-like movements occur. It is a further requirement for modern drawers that certain adjusting possibilities are provided, which means that the position of the drawer and in particular of the front plate with respect to the furniture body is adjustable so that, even in the case of inaccurately mounted supporting or pull-out rails, superjacently arranged drawers are exactly aligned and the joints between the front plates are of equal breadth.

Drawers are known which have adjusting means at the front ends of the supporting rails by means of which the drawer can be adjusted laterally or vertically of an article of furniture. These adjusting means necessitate however also a lateral relative movement between the pull-out rails and the supporting rails, which means that a compact lateral guiding therebetween cannot be obtained during the entire running movement of the drawer.

Pull-out rails are known from DE-A1-27 50 086 and DE-A1-36 32 442 which are adjustably fastened to drawers.

SUMMARY OF THE INVENTION

It is the object of the invention to provide an improved drawer of the above-mentioned type including adjusting means that are easily accessible and designed in a compact manner.

According to the invention, this object is achieved in that each adjusting means is held at the drawer by means of a vertically adjustable holding member or part which is mounted in a preferably T-shaped guiding recess of the adjusting means and movable therein by means of a height adjusting screw.

It is advantageously provided that the adjusting means has an oblong hole which is aligned parallel to the front plate and through which extends a clamping screw which engage in a female thread in a horizontal flange of the pull-out rails.

To facilitate mounting, each holding part may have a bolt which can be inserted into the front plate. Adjustment of the holding part is advantageously obtained by means of a lateral projection of the holding part which extends through a vertical slot of the adjusting means and into an annular groove of the height adjusting screw.

The arrangement of the adjusting means is advantageously such that the pull-out rails have C-shaped profiles which terminate slightly before the front plate and that the adjusting means are located between the front plate and the C-shaped profiles.

To obtain a lateral adjustment of the entire drawer, which means not only of its front region but also its rear region, one embodiment of the invention provides that the pull-out rails have at their rear ends upwardly extending projections or flaps each of which has a horizontal oblong hole through which projects a fastening screw.

Further, it is advantageously provided that the clamping screw for the lateral adjustment and the height adjustment screw are provided in the adjusting means in a plane which is parallel to the front plate.

BRIEF DESCRIPTION OF THE DRAWINGS

In the following an embodiment of the invention will be described in more detail with reference to the accompanying drawings, in which.

DETAILED DESCRIPTION OF THE INVENTION

Figure 1:
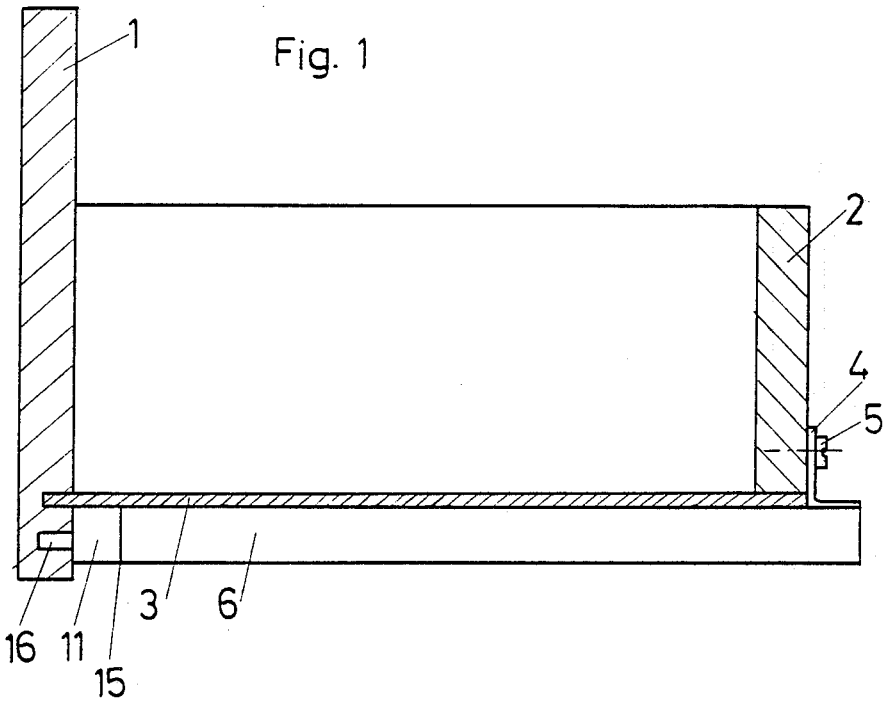
FIG. 1 is a longitudinal sectional view of a drawer according to the invention.
Figure 2:
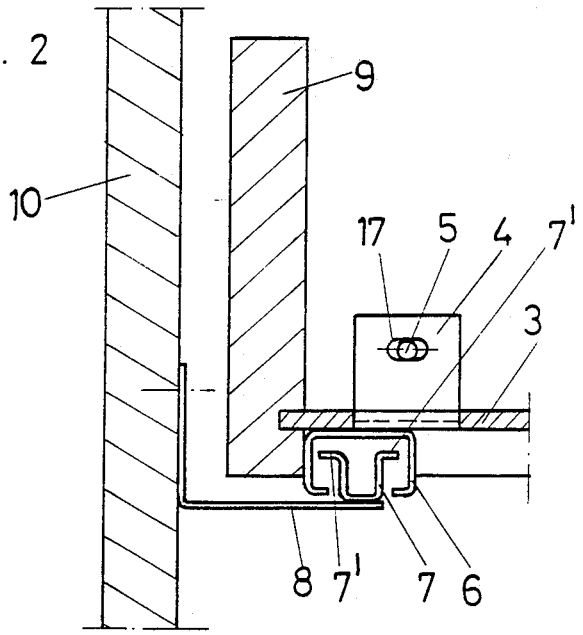
FIG. 2 is an enlarged partial sectional view of a rear holding means of a pull-out rail.
Figure 3:
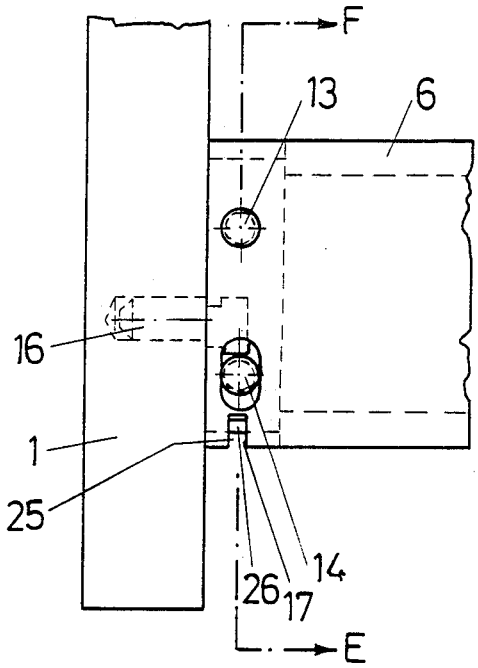
FIG. 3 is a plan view of an adjusting means seen from above.
Figure 4:
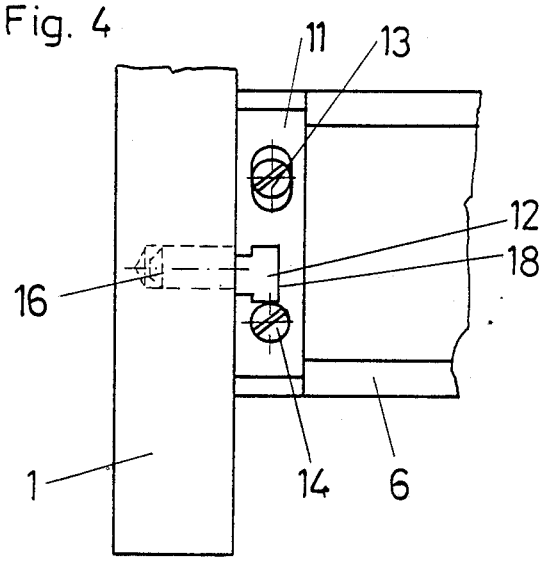
FIG. 4 is a plan view of the adjusting means seen from below.

As can particularly be seen from FIG. 2, a pull-out rail 6 is arranged below the bottom 3 in an angle or area of juncture between the bottom 3 and the side wall 9. FIG. 2 shows only the left side of the drawer. The right side is obviously analogous thereto. In the following description, reference will be made to one side of the drawer only for the sake of simplicity. The pull-out rail 6 has a C-shaped profile and embraces a supporting rail 7 which has a U-shaped profile and comprises at its upper rims outwardly projecting horizontal flanges 7'. Load-transmitting rollers which are preferably mounted in a running carriage are arranged between the pull-out rail 6 and the supporting rail 7. The rollers are not shown in the drawings and are arranged according to the state of the art. It is important that guiding of the pull-out rail 6 on the supporting rail 7 is effected essentially without clearance. The supporting rail 7 is fastened to a body side wall 10 by means of support members or flaps 8.

The pull-out rail 6 carries at its front end, directly behind the front plate 1, a block-shaped adjusting means or body 11. The C-shaped profile of the pull-out rail 6 terminates at a position 15 directly before the adjusting means 11. As can particularly be seen from FIG. 5, a vertically adjustable holding part or member 12 is mounted in the adjusting means 11, holding part 12 having a projection or bolt 16 which is insertable into a bore in the front plate 1. The bolt 16 forms the only anchoring means between the pull-out rail 6 and the drawer at the front end of the pull-out rail 6.

At the rear, the pull-out rail 6 has an upwardly projecting member or flap 4 which has a horizontal oblong hole 17 through which extends a fastening screw 5. By means of the fastening screw 5, the flap 4 and thus the pull-out rail 6 is fastened to the rear wall 2 of the drawer. The pull-out rail 6 can be laterally adjusted over the breadth of the oblong hole 17, when the fastening screw 5 is in the loosened condition.

As already mentioned, holding part 12 which carries the bolt 16 is mounted in the adjusting means 11. The entire unit comprising adjusting means 11 and pull-out rail 6 is mounted on the front plate 1 by means of bolt 16. The holding part 12 is guided in a T-shaped guiding recess 18 formed in the adjusting means 11.

Figure 5:
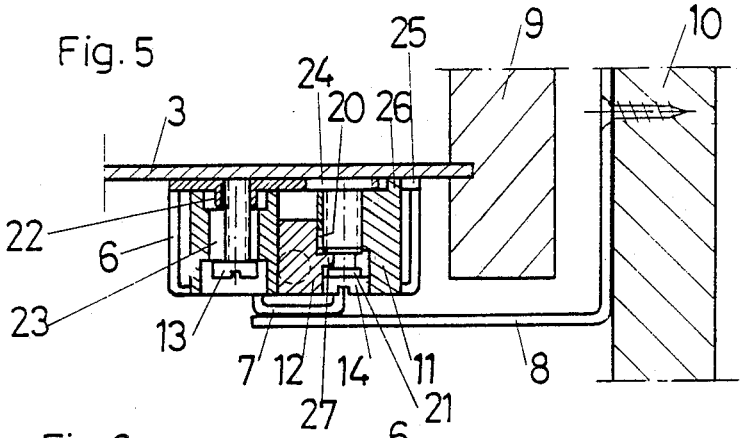
FIG. 5 is a sectional view along line 5—5 of FIG. 3.
Figure 6:
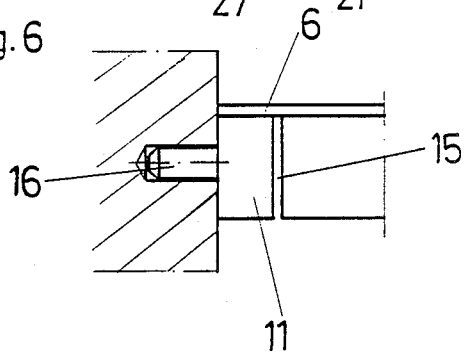
FIG. 6 is an enlarged partial sectional view showing fastening of the adjusting means to a front plate.

The holding part 12 further has a laterally extending projection 27 which projects through a slot 20 in the adjusting means 11 and is received in an annular groove 21 formed in a height adjusting screw 14 that is threaded in a threaded opening in adjusting means 11, as shown in FIG. 5. By turning the height adjusting screw 14 the holding part 12 is moved vertically, whereby the drawer can be lifted or lowered relative to the pull-out rails 6.

A clamping screw 13 which serves for lateral adjustment is arranged laterally adjacent the height adjusting screw 14. The height adjusting screw 14 and the clamping screw 13 are located in a plane parallel to the front plate 1. The clamping screw 13 is threaded in a female thread 22 in an upper horizontal flange of the pull-out rail 6. Moreover, the clamping screw 13 extends through an oblong hole 23 formed in adjusting means 11 and aligned parallel to the front plate 1. When the clamping screw 13 is loosened, the drawer can be laterally adjusted with respect to the pull-out rail 6, and thus with respect to the unit comprising pull-out rail 6 and supporting rail 7, over the length of the oblong hole 23. Above the height adjusting screw 14, a recess 24 having a dimension in a direction parallel to front plate 1 corresponding to the oblong hole 23 is provided in the horizontal flange of the pull-out rail 6 so that the lateral adjustment of the drawer does not impede the vertical adjustment.

A slot 25, into which projects a projection or nose 26 of the adjusting means 11, is laterally arranged in the horizontal flange of the pull-out rail 6. The nose 26 together with the rims of the slot 25 prevent twisting of the adjusting means 11 when the clamping screw 13 is loosened.

Figure 7:
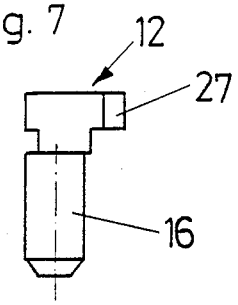
FIGS. 7 and 8 are plan and front views of a holding part or member.
Figure 8:
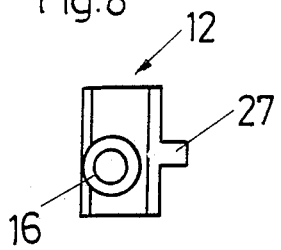
Figure 9:
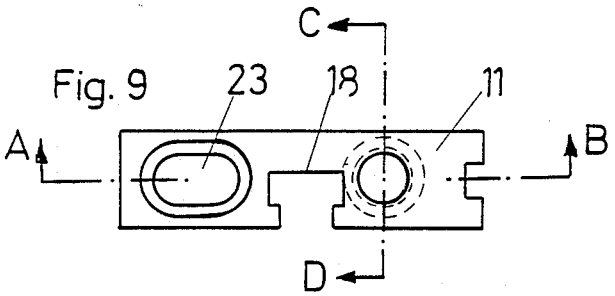
FIG. 9 is a plan view of the adjusting means.
Figure 10:
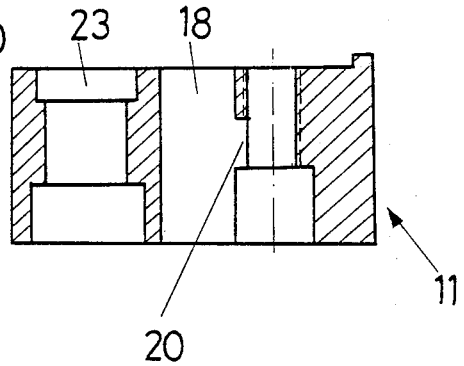
FIG. 10 is a sectional view along line 10—10 of FIG. 9.
Figure 11:
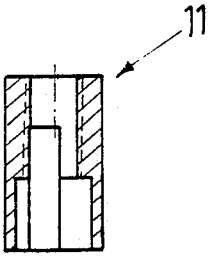
FIG. 11 is a sectional view along line 11—11 of FIG. 9.

As can be seen from FIGS. 7 and 8, the bolt 16 is eccentric with respect to the holding part 12, but is laterally concentrically aligned with respect to the adjusting means 11.

I claim:

1. In a drawer including a bottom, two side walls, a rear wall, a front plate, a pair of pull-out rails, each having a horizontal flange and to be mounted on said drawer adjacent a respective side thereof, and a pair of supporting rails, each to be mounted on a respective side of a furniture body and supporting a respective said pull-out rail for relative longitudinal sliding movement therebetween without substantial clearance and non-adjustably in vertical and lateral directions, the improvement comprising means at each side of said drawer for mounting a front end of the respective said pull-out rail to said drawer and for enabling vertical and lateral adjustment of said drawer relative to said pull-out rails, said mounting and adjustment means comprising:

an adjusting body positioned adjacent said front end of said respective pull-out rail, said adjusting body having therein a vertical guiding recess, a vertical opening, a vertical slot extending between said guiding recess and said vertical opening, and a vertical oblong hole elongated laterally in a direction parallel to the plane of said front plate;

a height adjustment screw mounted within said vertical opening and having a groove;

a holding body mounted within said guiding recess and movable vertically therein relative to said adjusting body, said holding body having a first projection supporting said front plate and a lateral projection extending through said vertical slot in said adjusting body and into said groove in said height adjustment screw, such that rotation of said height adjustment screw causes vertical movement of said holding body relative to said adjusting body, thereby causing vertical movement of said front plate and said drawer relative to said front end of said pull-out rail; and a clamping screw extending through said oblong hole and threaded into said horizontal flange of said respective pull-out rail, such that tightening of said clamping screw clamps said adjusting body and thereby said front plate said drawer relative to said front end of said pull-out rail, and such that loosening of said clamping screw enables said adjusting body and thereby said front plate and said drawer to be moved laterally relative to said front end of said pull-out rail within limits defined by said oblong hole.

2. The improvement claimed in claim 1, wherein said pull-out rail has a C-shaped profile section terminating rearwardly of said front plate, and said adjusting body is positioned between said front plate and said C-shaped profile section.

3. The improvement claimed in claim 1, wherein said height adjustment screw and said clamping screw are arranged in a plane extending parallel to said plane of said front plate.

4. The improvement claimed in claim 1, wherein said vertical opening in said adjusting body is threaded, said height adjustment screw is threaded into said threaded vertical opening, and said groove in said height adjustment screw is annular.

5. The improvement claimed in claim 1, wherein said guiding recess in said adjusting body has a T-shaped configuration.

6. The improvement claimed in claim 1, wherein said first projection of said holding body extends forwardly.

7. The improvement claimed in claim 1, further comprising a projection extending upwardly from a rear-end of said pull-out rail, said projection having therethrough a laterally oblong opening, and a fastening screw extending through said oblong opening into said rear wall, such that tightening of said fastening screw clamps said rear end of said pull-out rail relative to said drawer, and loosening of said tightening screw enables lateral adjustment of said rear end of said pull-out rail relative to said drawer within limits defined by said oblong opening.

8. An assembly for mounting a front end of a drawer pull-out rail to the drawer and for enabling vertical and lateral adjustment of the drawing relative to the pull-out rail, said assembly comprising:

an adjusting body to be positioned adjacent the front end of the pull-out rail, said adjusting body having therein a vertical guiding recess, a vertical opening, a vertical slot extending between said guiding recess and said vertical opening, and a vertical oblong hole elongated laterally in a direction to be parallel to the plane of a front plate of the drawer;

a height adjustment screw mounted within said vertical opening and having an annular groove.

a holding body mounted within said guiding recess and movable vertically therein relative to said adjusting body, said holding body having a first projection adapted to support the front plate and a lateral projection extending through said vertical slot in said adjusting body and into said groove in said height adjustment screw, such that rotation of said height adjustment screw causes vertical movement of said holding body relative to said adjusting body whereby it would be possible to cause vertical movement of the front plate and the drawer relative to the front end of the pull-out rail; and a clamping screw extending through said oblong hole and adapted to be threaded into a horizontal flange of the pull-out rail, such that tightening of said clamping screw makes it possible to clamp said adjusting body and thereby the front plate the drawer relative to the front end of the pull-out rail, and such that loosening of said clamping screw makes it possible to move said adjusting body and thereby the front plate and the drawer laterally relative to the front end of the pull-out rail within limits defined by said oblong hole.

9. An assembly as claimed in claim 8, wherein said height adjustment screw and said clamping screw are arranged in a plane adapted to extend parallel to the plane of the front plate.

10. An assembly as claimed in claim 8, wherein said vertical opening in said adjusting body is threaded, said height adjustment screw is threaded into said threaded vertical opening, and said groove in said height adjustment screw is annular.

11. An assembly as claimed in claim 8, wherein said guiding recess in said adjusting body has a T-shaped configuration.

12. An assembly as claimed in claim 8, wherein said first projection of said holding body extends forwardly in a direction orthogonal to said lateral projection.

* * * * *